US008907234B2

(12) United States Patent
Azzola et al.

(10) Patent No.: US 8,907,234 B2
(45) Date of Patent: Dec. 9, 2014

(54) HYBRID CURRENT SWITCHING DEVICE

(71) Applicant: ABB S.p.A., Milan (IT)

(72) Inventors: Lucio Azzola, Bergamo (IT); Antonello Antoniazzi, Milan (IT)

(73) Assignee: ABB S.p.A., Milan (IT)

( * ) Notice: Subject to any disclaimer, the term of this patent is extended or adjusted under 35 U.S.C. 154(b) by 140 days.

(21) Appl. No.: 13/749,743

(22) Filed: Jan. 25, 2013

(65) Prior Publication Data

US 2013/0199912 A1 Aug. 8, 2013

(30) Foreign Application Priority Data

Feb. 3, 2012 (EP) ..... 12153861

(51) Int. Cl.

| | |
|---|---|
| ***H01H 13/70*** | (2006.01) |
| ***H01H 89/00*** | (2006.01) |
| *H01H 71/12* | (2006.01) |
| *H01H 1/22* | (2006.01) |
| *H01H 71/46* | (2006.01) |

(52) U.S. Cl.

CPC ..... *H01H 89/00* (2013.01); *H01H 2071/124* (2013.01); *H01H 71/123* (2013.01); *H01H 1/225* (2013.01); *H01H 71/46* (2013.01)

USPC ..... 200/5 R

(58) Field of Classification Search

CPC ..... H01H 71/123; H01H 89/00; H01H 1/225; H01H 2071/124; H01H 71/46

USPC ..... 200/5 R, 304–306, 332, 400–401, 200/318–327

See application file for complete search history.

(56) References Cited

U.S. PATENT DOCUMENTS

| | | | | |
|---|---|---|---|---|
| 4,166,205 | A * | 8/1979 | Maier et al. | 200/400 |
| 4,264,796 | A * | 4/1981 | Nelson et al. | 200/400 |
| 4,491,709 | A * | 1/1985 | Chabot et al. | 200/400 |
| 2008/0309438 | A1 | 12/2008 | Caggiano et al. | |

FOREIGN PATENT DOCUMENTS

| | | |
|---|---|---|
| WO | WO 2008/153575 A1 | 12/2008 |
| WO | WO 2011/018113 A1 | 2/2011 |

OTHER PUBLICATIONS

*European Search Report dated Jul. 12, 2012.

* cited by examiner

*Primary Examiner* — Edwin A. Leon

(74) *Attorney, Agent, or Firm* — Buchanan Ingersoll & Rooney PC

(57) ABSTRACT

A hybrid current switching device has a casing which includes a main current switch having first fixed and movable contacts connected in series with first and second terminals, a power switch device connected in parallel with the main current switch and switchable between an on-state and an off-state, a secondary current switch having second fixed and movable contacts and being connected in series with the power switch device, and a movable-contacts holding shaft on which the first and second movable contacts are mounted. The contacts-holding shaft is positioned inside the casing rotating around a rotation axis to move the movable contacts between a closed position where they are coupled with the corresponding fixed contacts and an open position where they are electrically separated therefrom. The first and second movable contacts are mounted on the rotating shaft with an angular offset relative to each other when in the open position.

18 Claims, 6 Drawing Sheets

HYBRID CURRENT SWITCHING DEVICE

RELATED APPLICATION

This application claims priority under 35 U.S.C. §119 to European Patent Application No. 12153861.5 filed in Europe on Feb. 3, 2012, the entire content of which is hereby incorporated by reference in its entirety.

FIELD

The present disclosure relates to a hybrid current switching device, such as a circuit breaker or switch disconnector, for example, with integral isolation, which may be used in low-voltage applications.

BACKGROUND INFORMATION

For the purpose of the present disclosure, the term "low voltage" refers to applications with operating voltages up to 1000V AC/1500V DC.

As known, switching devices used in low voltage circuits, such as circuit breakers, disconnectors, and contactors, are protection devices designed to allow the correct operation of specific parts of the electric circuits in which they are installed, and of electric loads connected to such electric circuits or parts thereof.

For instance, they ensure the availability of the nominal current necessary for several utilities, enable the proper insertion and disconnection of loads from the circuit, and protect (especially for circuit breakers) the grid and the loads installed therein against fault events such as overloads and short circuits.

Numerous industrial solutions for the aforementioned devices are available on the market.

Known electro-mechanical switching devices generally have a case housing one or more electric poles, which each include a couple of separable contacts to make, break and conduct current. A driving mechanism causes the movable contacts to move between a first closed position in which they are coupled to the corresponding fixed contacts and a second open position in which they are spaced away from the corresponding fixed contacts.

In the closed position, well-designed contacts result in quite low power losses, whereas in the open position, they guarantee galvanic (electrical) isolation of the downstream circuit provided that the physical separation between the contacts are above a minimum value. Such galvanic isolation is important in common electrical practice, because it enables safe repairing and maintenance works on the circuit in which the switching device is inserted.

Although such known switching devices have proven to be very robust and reliable, in direct current ("DC") applications, and mainly at relatively high voltage (up to 1500V), the interruption time can be quite high, and therefore electric arcs which usually strike between mechanical contacts under separation may consequently last long.

Such long arcing times result in severe wear of the contacts, thus reducing significantly the electrical endurance, such as the number of switching operations that a switching device can perform.

In order to address such issues in DC applications, there have been designed so-called Solid-State Circuit Breakers (SSCBs) which use Power Electronics Switches (PES), using semiconductor-based power devices, such as Power MOSFETs, Insulated Gate Bipolar Transistors (IGBTs), Gate Turn-Off Thyristors (GTO) or Integrated Gate-Commutated Thyristors (IGCTs), that can be turned on and off by means of an electronics driving unit so as to have arcless current making and breaking operations.

The main advantage of such SSCBs is that they have potentially unlimited electrical endurance due to arcless operations. On the other hand, PES devices suitable for high currents, for example, above 100 A, have very high on-state conduction losses.

Therefore, SSCBs waste quite a lot of energy and require intensive cooling to remove the heat generated and keep the temperature at safe levels.

In order to mitigate these problems, there have been devised hybrid solutions where a known or main switching ("MS") device is connected in parallel to a PES device. The main switching device conducts the current in normal operations, while the PES device is only used at breaking or making current.

Such hybrid solutions have low power losses, in principle not higher than those of known switching devices, and therefore do not require special cooling also when continuously loaded at full power.

However, a drawback of PES devices is that in an off-state, if a voltage is applied to their terminals, for example, an anode and cathode for an IGCT, or collector and emitter for an IGBT, they conduct a small current (leakage current), for example, up to a few dozens of mA. As a result, SSCBs and hybrid solutions also have limited power losses in an open state and are not suitable for galvanic isolation.

This severe limitation can be avoided by means of another known switch referred to as an Isolation switch (IS) which is serially connected to the PES device.

The proper working of such complex device requires that the IS, MS and PES devices are operated in a very strict sequence and with tight timing in breaking and making operations. For example, in normal operating conditions, the MS and IS devices are closed, and the PES is in an off-state. When it is necessary to interrupt the flow of current (opening or current breaking operation), the PES device turns-on (with no current passing through, because the voltage across the device, for example, the voltage drop on the MS device, is generally lower than a threshold voltage, which is the Collector-Emitter Voltage ($V_{CE}$) in the case of IGBTs and the On-State Voltage ($V_T$) in the case of IGCTs), the MS device opens and an arc is ignited between its contacts. The arc voltage diverts the current towards the PES device, and the arc between the contacts of the MS device is extinguished right after. The PES device turns off breaking the main current, wherein this step should be executed only when the distance between the contacts of the MS device is large enough to avoid an arc reignition. Just after the IS device opens which also breaks the leakage current. When instead, it is necessary to close the contacts (current making operations), starting from a condition where the MS and IS devices are open, and the PES device is in an off-state, the IS device is closed first, thus making only the low leakage current. Then, the PES device turns-on making the main or nominal current, and after the MS device closes thus diverting the current from the PES device with a small arc between the contacts of the MS device itself.

In practice, the isolation switch device makes or breaks only small leakage currents, for example, smaller than 100 mA, and wear of its contacts is negligible. In the same way, the contacts of the MS device are also exposed only to small and short arcs and their wear is significantly reduced in comparison with traditional mechanical switchgear.

As a result, with hybrid solutions, a much higher number of electrical make or break operations even with high currents can be executed.

Notwithstanding, there is still a desire for further improvements of known hybrid solutions, such as with regard to simplifying their constructive layout, realizing a better synchronized coordination of their operations, and maintaining such synchronization over a longer and possible the entire working life.

SUMMARY

An exemplary embodiment of the present disclosure provides a hybrid current switching device which includes a casing having protruding outside thereof a first terminal and a second terminal configured for input and output electrical connection with an associated electrical circuit, respectively. The exemplary hybrid current switching device also includes, positioned inside the casing, a main current switch including a first fixed contact and a corresponding first movable contact. The first fixed and movable contacts are connected in series with and positioned between the first and second terminals. In addition, the exemplary hybrid current switching device includes, positioned inside the casing, a power electronics switch configured to be connected in parallel with the main current switch and to be switched between an on-state and an off state. The exemplary hybrid current switching device also includes, positioned inside the casing, a secondary current switch having a second fixed contact and a corresponding second movable contact, the secondary current switch being connected in series with the power electronics switch. Furthermore, the exemplary hybrid current switching device includes, positioned inside the casing, a movable-contacts holding shaft on which the first movable contact and the second movable contact are mounted. The movable-contacts holding shaft is positioned inside the casing rotating around a rotation axis so as to move the first and second movable contacts between a closed position in which the first and second movable contacts are coupled with the first and second fixed contacts, respectively, and an open position in which the first and second movable contacts are electrically separated from the first and second fixed contacts. The first and second movable contacts are mounted on the movable-contacts holding shaft with an angular offset relative to each other when in the open position.

BRIEF DESCRIPTION OF THE DRAWINGS

Additional refinements, advantages and features of the present disclosure are described in more detail below with reference to exemplary embodiments illustrated in the drawings, in which.

Figure 1:
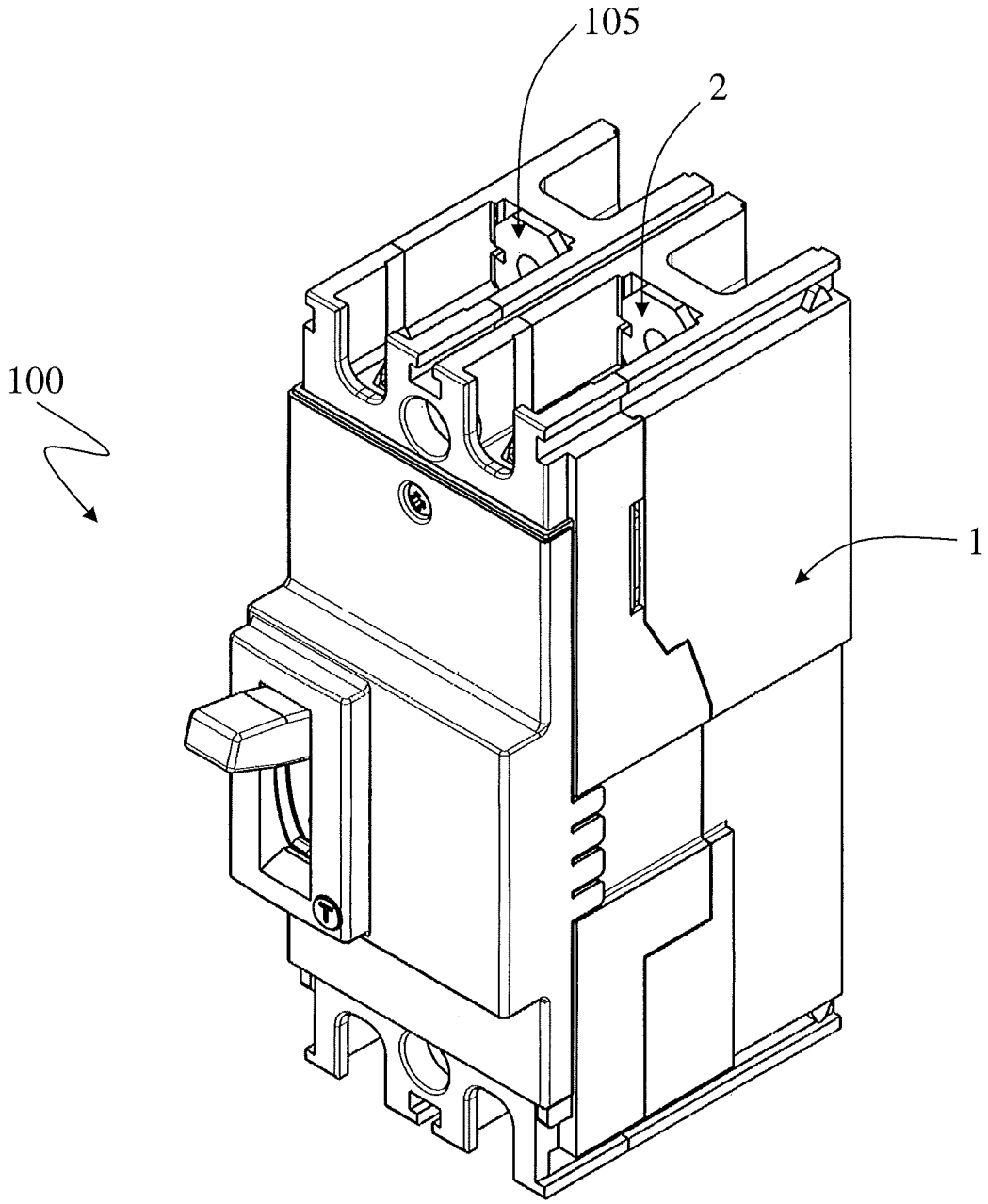
FIG. 1 is a perspective view showing an exemplary embodiment of a hybrid current switching device according to the present disclosure.

It should be noted that in the detailed description that follows, identical or similar components, either from a structural and/or functional point of view, have the same reference numerals, regardless of whether they are shown in different exemplary embodiments of the present disclosure. It should also be noted that in order to clearly and concisely describe the exemplary embodiments of the present disclosure, the drawings may not necessarily be to scale and certain features of the disclosure may be shown in somewhat schematic form.

DETAILED DESCRIPTION

Exemplary embodiments of the present disclosure provide a hybrid current switching device which includes a casing having protruding outside thereof at least a first terminal and a second terminal which are configured for input and output electrical connection with an associated electrical circuit, respectively. The hybrid current switching device also includes, positioned inside the casing, a main current switch having a first fixed contact and a corresponding first movable contact. The first fixed and movable contacts are connected in series with and positioned between the first and second terminals. The hybrid current switching device also includes, positioned inside the casing, a power switch device which is connected in parallel with the main current switch and configured to be switched between an on-state and an off state. In addition, the hybrid current switching device includes, positioned inside the casing, a secondary current switch having a second fixed contact and a corresponding second movable contact. The secondary current switch is connected in series at least with the power switch device. Furthermore, the hybrid current switching device includes, positioned inside the casing, a movable-contacts holding shaft on which the first movable contact and the second movable contact are mounted. The movable-contacts holding shaft is positioned inside the casing rotating around a rotation axis so as to move the first and second movable contacts between a closed position in which the first and second movable contacts are coupled with the first and second fixed contacts, respectively, and an open position in which the first and second movable contacts are electrically separated from the first and second fixed contacts. The first and second movable contacts are mounted on the movable-contacts holding shaft with an angular offset relative to each other when in the open position.

In the following description, a hybrid current switching device according to an exemplary embodiment of the present disclosure will be described with reference to an exemplary molded case circuit breaker without intending in any way to limit its possible applications to different types of switching devices and with any suitable number of phases or poles.

In particular, FIG. 1 shows an exemplary embodiment of a hybrid current switching device in the form of a bipolar-like molded case circuit breaker indicated by the overall reference number 100 and is hereinafter referred to as the "hybrid device 100" for the sake of simplicity.

Figure 2:
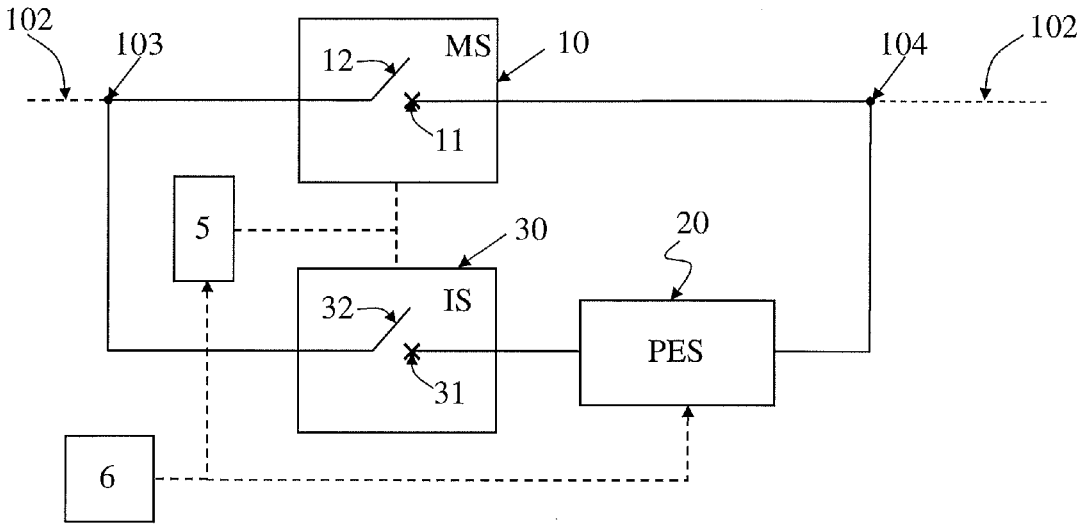
FIGS. 2 and 3 are block diagrams schematically illustrating two exemplary embodiments of a hybrid current switching device according to the present disclosure.
Figure 3:
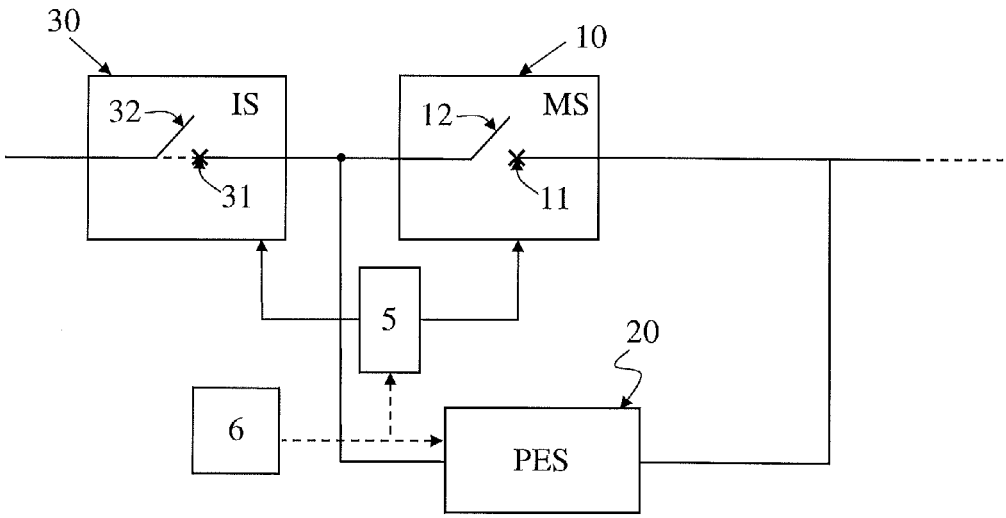
Figure 4:
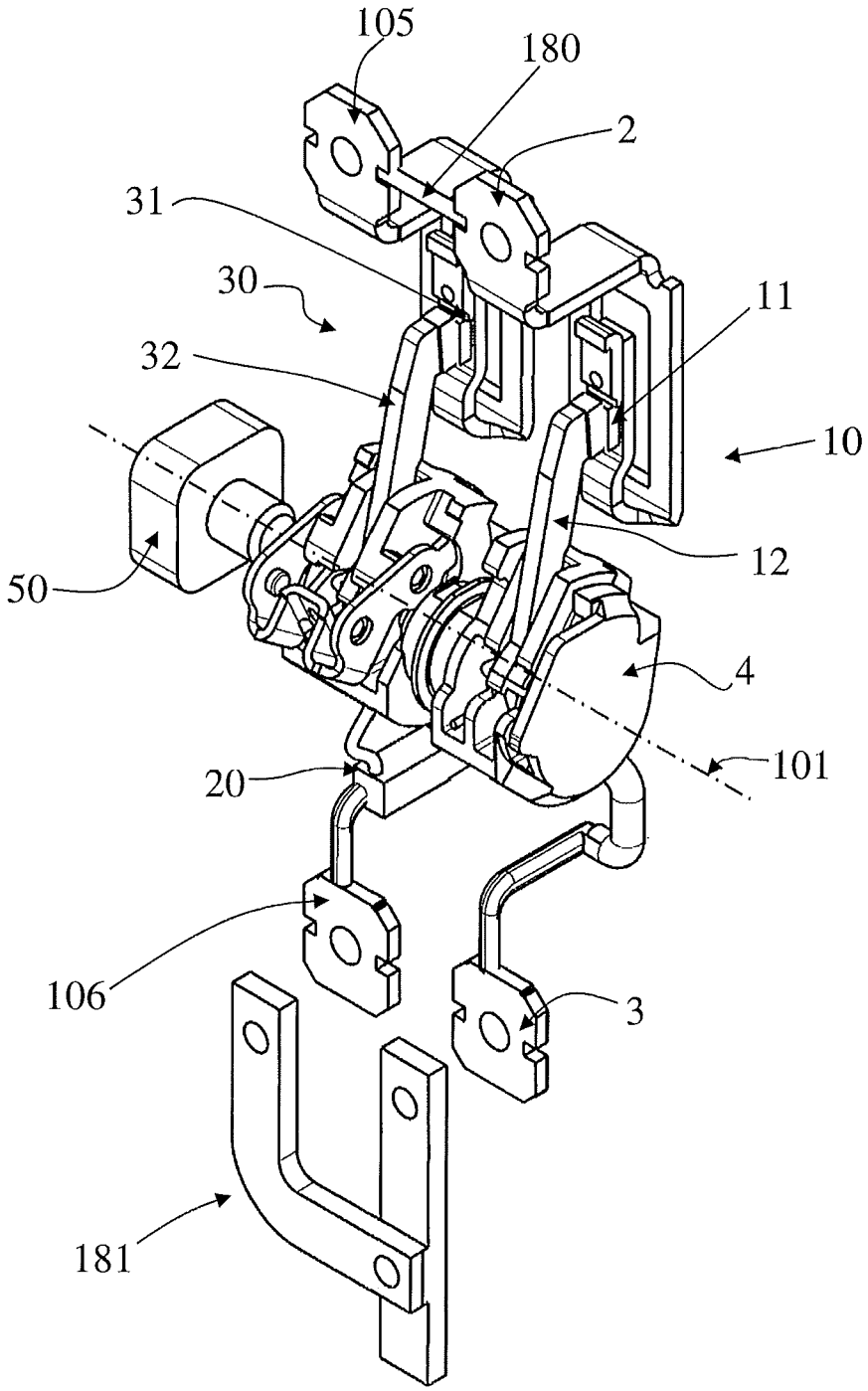
FIGS. 4 and 7 are perspective views showing some components of the device of FIG. 1 according to two different electrical layouts related to those of FIGS. 2 and 3, respectively.
Figure 7:
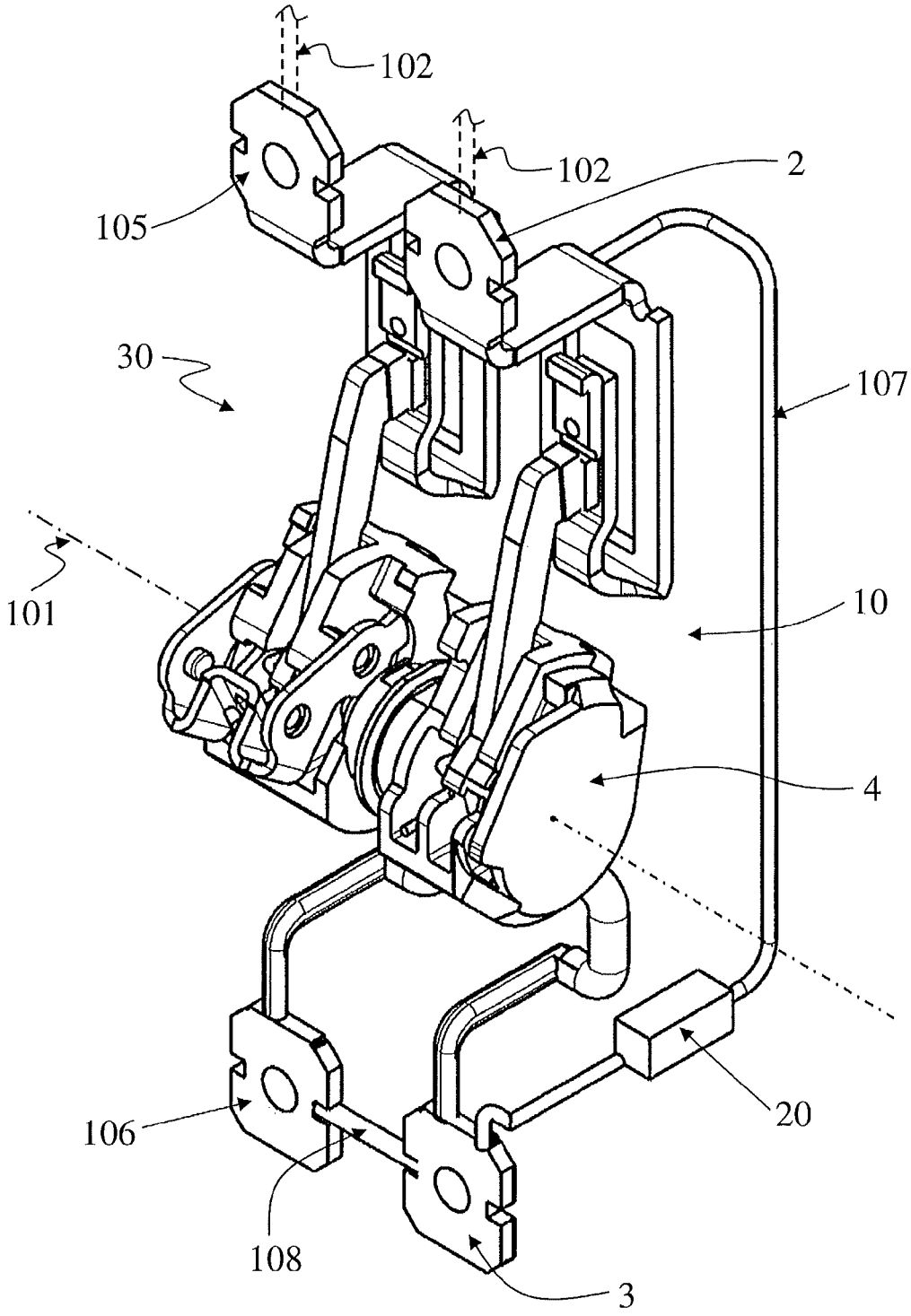

As illustrated, the hybrid device 100 includes a casing 1, which can be made, for example, of plastics, from which protrudes outside thereof at least two terminals configured for input and output electrical connection, respectively, with a conductor of an associated electrical circuit schematically represented in FIGS. 2-3 by the reference number 102. In FIG. 1, there are directly visible only the terminals at the upper part of the device 100, namely a first terminal 2 and a terminal 105 (hereinafter referred to as the third terminal 105). In FIGS. 4 and 7, there are illustrated in addition the terminals at the lower part of the device 100, namely a second terminal 3 and a fourth terminal 106.

The hybrid device 100 includes, positioned inside the casing 1, a main current switch (MS) 10 which has a first fixed contact 11 and a corresponding first movable contact 12. The first fixed contact 11 and the first movable contact 12 are connected in series with and positioned between the first terminal 2 and the second terminal 3. In accordance with an exemplary embodiment, the main current switch 10 constitutes a current interrupter unit configured to conduct the current in normal operating conditions and to be the first one to intervene and break the flow of current in the circuit 102 in the case of fault currents due, for example, to short circuits.

Inside the casing 1, there is provided a power electronics switch (PES) 20 which is configured to be connected in parallel with the main current switch 10 and can be switched between an on-state (e.g., a conducting-state) and an off state (e.g., a non-conducting state). In accordance with an exemplary embodiment, the power electronics switch 20 can be a semiconductor-based device and can include, for example, one or more IGBTs, thus representing in practice a solid state circuit breaker or switch, also indicated sometimes as static circuit breaker.

Inside the casing 1, there is also provided a secondary current switch (IS) 30 which has a second fixed contact 31 and a corresponding second movable contact 32.

The secondary current switch 30 is connected in series at least with the power switch device 20.

In accordance with an exemplary embodiment, as illustrated in FIGS. 2 and 4, the secondary current switch 30 is connected in series with the power electronics switch 20, and both the secondary current switch 30 and the power electronics switch 20 are connected electrically in parallel with the main current switch 10. For example, the electrical parallel connection can be realized at points 103 and 104 which can be outside or inside the casing 1 by means of suitable conductors.

In the exemplary embodiment of FIG. 4, the secondary current switch 30 and the power electronics switch 20 are positioned between the terminals 105 and 106, and the circuit 102 is connected at an input and output with the hybrid device 100 through the terminals 2 and 3, respectively. In turn, the terminal 2 is connected to the terminal 105 by means of an electrical conductor 180, and the terminal 106 is connected with the phase circuit 102 by means of a further conductor 181.

Alternatively, as illustrated in FIGS. 3 and 7, the secondary current switch 30 can be connected in series with both the power electronics switch 20 and the main current switch 10. For example, as illustrated in FIG. 7, the power electronics switch 20 can be positioned along a conductor 107 which is operatively connected at both ends with the terminals 2 and 3. In turn, the series connection with the secondary current switch 30 can be realized by means of a further conductor 108 electrically connecting the two terminals 106 and 3, or even the two terminals 3 and 106 can be realized in a unique piece, or another configuration. In this case, the hybrid device 100 can be connected in an input and output with the phase circuit 102 through the terminals 105 and 2, respectively.

In accordance with an exemplary embodiment, as it will be more apparent from the following description, the secondary current switch 30 can constitute an isolation switch device which makes or breaks only small leakage currents, for example, below 1 A, and is configured to intervene, during opening operations, only after the main current switch 10, for the sake of realizing a galvanic isolation along the circuit 102, and in particular between the input and output connections of the circuit 102 with the hybrid device 100 itself.

As illustrated in the various embodiments, the hybrid device 100 includes a movable-contacts holding shaft 4 on which the first movable contact 12 and the second movable contact 32 are mounted. The movable-contacts holding shaft 4 is positioned inside the casing 1 rotating around a rotation axis 101 so as to move the first movable contact 12 and the second movable contact 32 between a closed position in which the first movable contact 12 and the second movable contact 32 are coupled with the first fixed contact 11 and the second fixed contact 31, respectively, and an open position in which the first movable contact 12 and the second movable contact 32 are electrically separated from the first fixed contact 11 and the second fixed contact 31, respectively.

Figure 5:
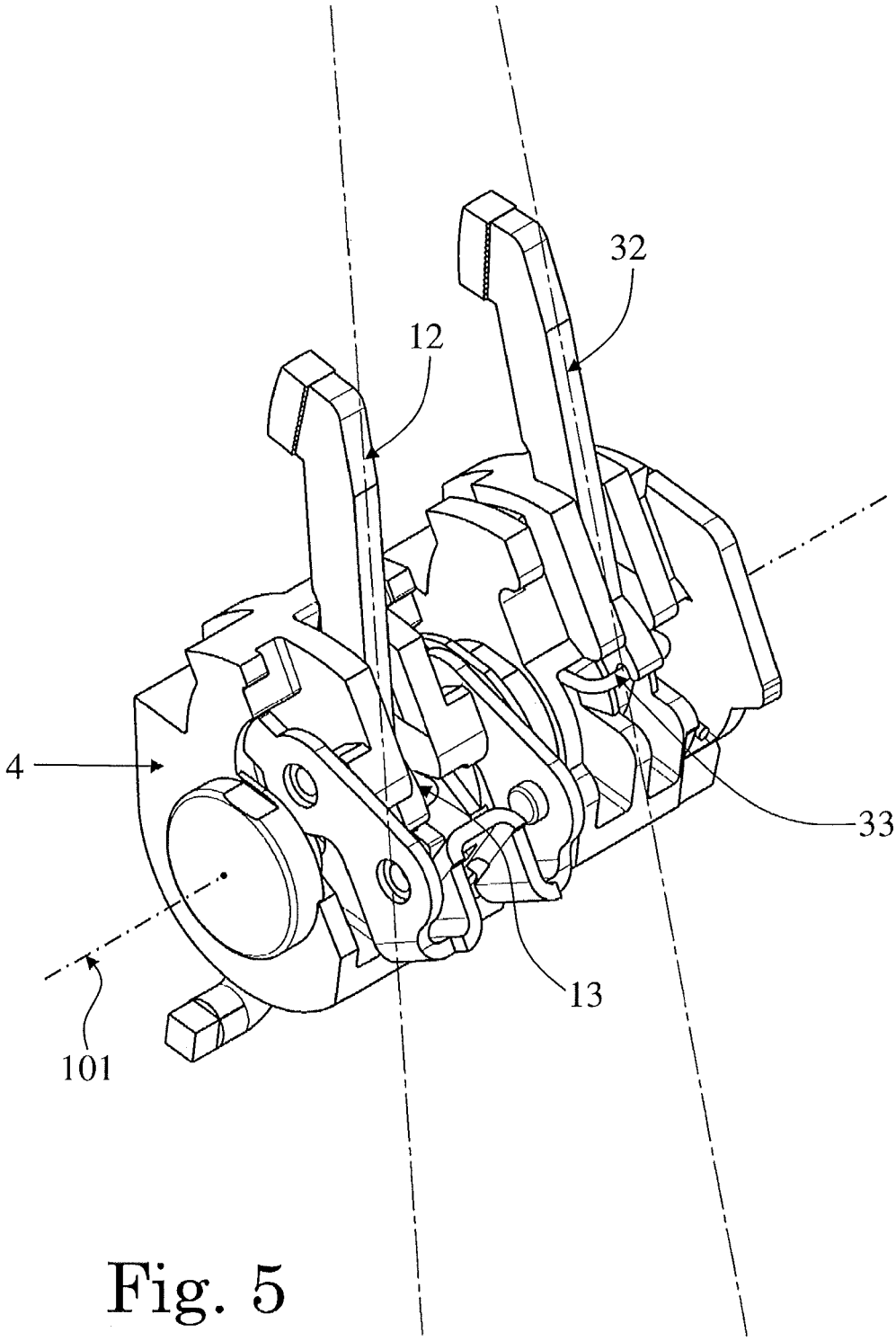
FIG. 5 is a perspective view illustrating a movable-contact holding shaft with movable contacts mounted thereon used in the device of FIG. 1.
Figure 6:
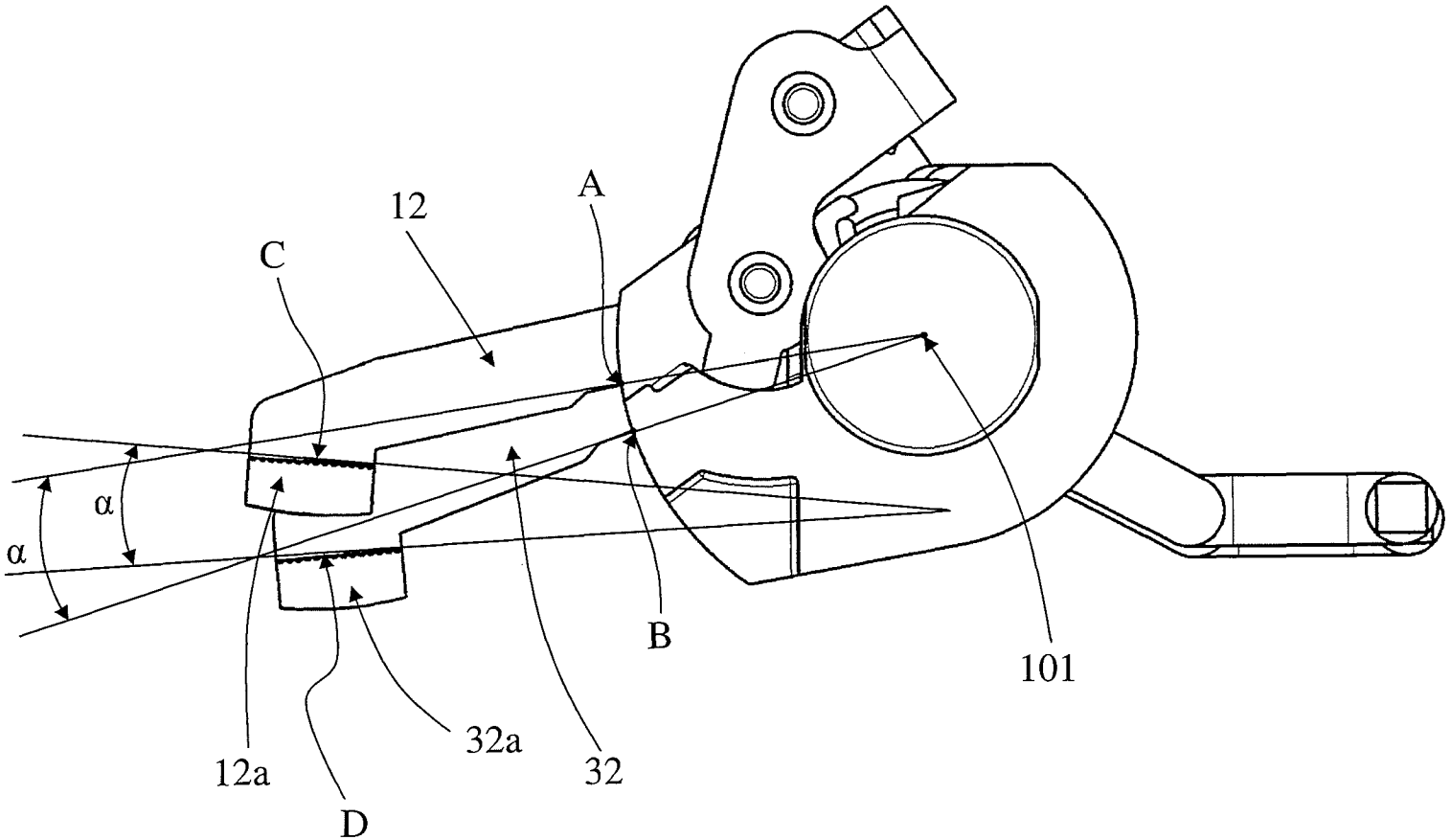
FIG. 6 is a side plane view of FIG. 5.

In accordance with an exemplary embodiment, as illustrated in FIGS. 5 and 6, with reference to the rotation axis 101 (and shaft 4 seen in a plane perpendicular to the rotation axis 101 itself), the first movable contact 12 and the second movable contact 32 are mounted on and along the movable-contacts holding shaft 4 side by side and with an angular offset relative to each other.

In accordance with an exemplary embodiment, when the device 100 is in the open position (which corresponds to the mounting configuration) the two movable contacts 12 and 32 form therebetween an angle $\alpha$ which is between 3° and 60°, for example, between 5° and 50°.

According to the manner and for the reasons which will be described more in detail hereinafter, such an angular offset in practice contributes to realize the specific sequence of opening/closing between the main current switch 10 and the secondary current switch 30, for example, with the desired delay between them. The specific value of the angle $\alpha$ can be selected based on the specific application, for example, the size and/or type of device 100, such as in dependence on the angular velocity of the shaft 4.

Such an a angle can be measured in a plane perpendicular to the rotation axis 101 and is, for example (see FIG. 6), formed by two rectilinear lines starting from the axis 101 and passing from the points "A" and "B" at which the lower parts of the body of the movable contacts 32 and 12 emerge from the shaft 4, respectively. Alternatively, the angle $\alpha$ can be measured as that formed by two lines directed along the respective surfaces "C" and "D" of the body of the movable contacts 32 and 12 at which the contact tips or pads 32*a* and 12*a* are fixed, or vice versa.

In accordance with an exemplary embodiment, the hybrid device 100 according to the present disclosure includes a single actuation mechanism, schematically indicated in FIGS. 2, 3 by the reference number 5 which is operatively connected to the movable-contacts holding shaft 4 for actuating both the main current switch 10 and the secondary current switch 30, and for causing the movement of their respective movable contacts 12 and 32 between the open and closed positions.

In accordance with an exemplary embodiment, the single actuating mechanism 5 is configured so that the first and second movable contacts 12, 32 are substantially aligned to each other when in the closed position under the action exerted by the actuating mechanism 5 itself.

Further, in the illustrated exemplary embodiments, the actuating mechanism 5 includes a first contact-pressing spring 13 which is connected to the first movable contact 12 and a second contact-pressing spring 33 which is connected to the second movable contact 32.

In a closed position, and under the action of the actuating mechanism 5, the springs 13 and 33 press the moving contacts 12 and 32 against the respective mating fixed contacts 11 and 31 thus avoiding electrodynamic lifting of the movable contacts at high currents. In accordance with an exemplary embodiment, the stiffness of the contact-pressing springs 13 and 33 may be such that the resulting contact force on the contact 32 is higher than that on contact 12. For example, depending of the specific application, the springs can have the same or different stiffness.

In accordance with an exemplary embodiment, the first and second movable contacts 12, 32 are mounted on the movable-contacts holding shaft 4 with an angular offset relative to each other (that is, forming an angle $\alpha$ therebetween) which corresponds to the open position. When the device 100 is closed, the movable contacts 12 and 32, under the pressure exerted by the actuating mechanism (and related springs 13, 33) are substantially aligned (e.g., they overlap) to each other (when looking at the movable contacts in a plane perpendicular to that of the rotation axis 101).

When opening the main current switch 10 and the secondary current switch 30, for example, upon an opening command issued by a command unit operatively associated to the single actuating mechanism 5, the second movable contact 32 starts to physically separate from the second fixed contact 31 only when the first movable contact 12 is spaced apart from the first fixed contact 11 of at least a predetermined distance. Such a predetermined distance, which can range, for example, between 1 mm and 10 mm, represents a safety distance at which a re-ignition of an electrical arc between the contacts 11 and 12 of the main current switch 10 is not possible.

According to an exemplary embodiment, the actuation mechanism 5 is configured to move the movable-contacts holding shaft 4 at a variable angular speed at least when causing the shaft 4 to rotate from the closed position to the open position. In accordance with an exemplary embodiment, the variability of the angular speed is controlled.

According to an exemplary embodiment, the single actuating mechanism 5 includes a self-locking motor. For example, the self-locking motor includes a piezoelectric ultrasonic rotary motor, such as type USR45 marketed by Fukoku Co. Ltd. (Japan), schematically represented by the reference number 50 only in FIG. 4 for the sake of simplicity.

In this case, and depending on the application, the above mentioned motor can be positioned inside or outside the casing 1 and can be directly connected to the movable-contacts holding shaft 4 or through the interposition of mechanical connecting elements according to solutions readily available to those skilled in the art.

Alternatively, the single actuation mechanism 5 can be constituted by readily available spring mechanisms, by an electromagnetic actuator, for example, a stepper motor, or by similar and/or other suitable actuating devices, according to solutions well known in the art and therefore not described herein in details.

The hybrid device 100 according to the present disclosure also includes a command unit which is schematically represented in FIGS. 2 and 3 by the reference number 6.

Such command unit 6, which can be also positioned inside or outside the casing 1 even at a remote location, can be, for example, a micro-processor based electronic device, such as an electronic Intelligent Electronic Device (IED) or relay or trip unit, for example, of any suitable type available on the market, and is configured to drive and switch the power electronics switch 20 between the on-state and the off-state.

In accordance with an exemplary embodiment, when it is necessary to execute an opening operation (e.g., the contacts of the main current switch 10 and successively the contacts of the secondary current switch 30 have to be electrically separated) the command unit 6 is configured to switch the power electronics switch 20 from an off-state to an on-state before the first movable contact 12 starts to physically separate from the first fixed contact 11. In accordance with an exemplary embodiment, when executing such an opening operation, the power electronics switch 20 is turned on while the movable contact 12 still physically touches the respective fixed contact 11 (e.g., there is not space between the mating surfaces of the contacts 11 and 12).

Further, still when executing opening of the main current switch 10 and of the secondary current switch 30, the command unit 6 is configured to switch the power switch device 20 from an on-state to an off-state after the first movable contact 12 is spaced apart from the first fixed contact 11 of at least a predetermined distance and before the second movable contact 32 starts to physically separate from the second fixed contact 31.

According to an exemplary embodiment, when it is necessary to execute a closing operation (e.g., the contacts of the secondary current switch 30 and successively of the main current switch 10 have to couple), the command unit 6 is also configured to turn on the power switch device 20 after the second movable contact 32 is coupled with the second fixed contact 31 and before the first movable contact 12 starts to mechanically touch the first fixed contact 11.

According to an exemplary embodiment, the command unit 6 is configured to also drive the single actuating mechanism 5.

In accordance with an exemplary embodiment, the command unit 6 can be configured to issue one or more signals driving the associated single actuating mechanism 5 and the power electronics switch 20 in a coordinated way. For example, such one or more signals can be generated by a unique circuit or by respective circuits part of the same command unit 6.

Alternatively, it is possible to have two separate command units operating in a coordinated way where one of the command units drives the power electronics switch 20 while the other one drives the actuating mechanism 5.

The opening and closing operation of the hybrid device 100 according to the present disclosure will be now described in more detail.

For example, in normal operating conditions, the current flows in the circuit 102 passing through the hybrid device 100 and in particular through the contacts 11-12 of the main current switch 10 which are coupled to each other. In this case, the main current switch 10 is closed, the secondary current switch 30 is also closed, and the power electronics switch 20 is in an off-state, that is, it is not conducting current.

If opening is needed, for example, based on a command signal(s) issued by the command unit 6, at time $t_{op0}$ the power electronics switch 20 is turned-on by the command unit 6, i.e. it is switched from the off- to the on-state, and the shaft 4 actutated by the associated actuating mechanism 5 starts rotating, while the respective fixed and movable contacts of the main and secondary current switches 10 and 30 remain still closed. After an initial idle angle of rotation, at time $t_{op1}$, for example, after a time ranging from 0.1 ms up to 10 ms or even up to a few tens of ms, the contacts 11-12 of the main current switch 10 start to separate from each other while the contacts 31-32 of the secondary current switch 30 remain still closed. In this case, the current starts to be diverted towards the power electronics switch 20 hold in the on-state. The shaft 4 continues to rotate until (at time $t_{op2}$), for example, after an interval between 0.1 ms and 10 ms from $t_op_1$, the movable contact 12 of the main current switch 10 reaches the above mentioned safe distance from the fixed contact 11, that is, the distance between the contacts 11 and 12 is such that the re-ignition of electric arcs between them can not occur; the main current switch 10 is thus electrically open. At this point, the contacts 31-32 of the secondary current switch 30 are still closed while the power electronics switch 20 is turned-off (e.g. again by the command unit 6) thus breaking the main current. The driving shaft 4 continues its rotation and the movable contact 32 of the secondary switch 30 starts to separate from the associated fixed contact 31 until the separation of the contacts 31-32 is complete at time $t_{op3}$ (e.g. after a time interval ranging between 0.1 ms and 10 ms counted from time $t_{op2}$), and therefore the secondary current switch 30 is opened breaking also the leakage current. At time $t_{op4}$ (e.g. after a time interval ranging between 0.1 ms and 10 ms counted from time $t_{op3}$) the shaft 4 reaches the end position and stops. The opening operation is thus completed from electrical and mechanical points of view.

If starting from an open position with the secondary current switch 30 and the power electronics switch 20 open, the hybrid device 100 has to be closed, for example, following closing command signal(s) issued for instance by the command unit 6, under the action of the actuating mechanism 5, the shaft 4 starts (time $t_{clo0}$) rotating driving with it the moving contacts 12 and 32 of the two switches 10 and 30. During the rotation, at time $t_{clo1}$ (e.g., after a time ranging from 0.1 ms up to 10 ms or even up to a few tens of ms), the movable contact 32 couples with the fixed contact 31, that is, the secondary current switch 30 closes thus making the leakage current, while the power electronics switch 20 is still in the off-state and the main current switch 10 is still electrically open (namely the distance of the contacts 11 and 12 is such that there is not electrical conduction between them). At time $t_{clo2}$, (e.g. after a time interval ranging between 0.1 ms and 10 ms counted from time $t_{clo1}$) the power electronics switch 20 is turned-on, for example, by the command unit 6, making the main current, while the main current switch 10 is still open. The shaft 4 continues to rotate until at time $t_{clo3}$ (e.g. after a time interval ranging between 0.1 ms and 10 ms counted from time $t_{clo2}$) the contacts 11-12 are coupled, that is, the main current switch 10 closes diverting the current from the power electronics switch 20. The shaft continues rotating until (time $t_{clo4}$) (e.g., after a time interval ranging between 0.1 ms and some tens of milliseconds, for example, 50 ms counted from time $t_{clo3}$) it reaches the end position and stops; the closing operation is thus completed.

As previously indicated, the actuating mechanism 5 can cause the shaft 4 to rotate at a controlled variable angular speed at least during opening. For example, during a first phase of the opening operation, the shaft 4 can rotate at a certain constant or variable, e.g. increasing, angular speed from the time ($t_{op0}$) the opening operation is started until when (end of time $t_{op2}$) the movable contact 12 of the main current switch 10 reaches the above mentioned safe distance from the fixed contact 11 and thus the main current switch 10 is electrically opened. During a second phase, namely from the time $t_{op2}$ until the opening operation is completed (end of time $t_{op4}$), the shaft 4 can rotate at an angular velocity which is different from, for example, lower than, that of the above described first phase. Also, during the second phase, the related angular velocity can be constant or variable, for example, decreasing.

If desired, for example, when using a self-breaking motor as the actuating mechanism 5, it is even possible to stop the rotation when the main current switch 10 is opened, for example, at the end of $t_{op2}$, and then restart the rotation of the shaft 4 for completing the opening operation (from $t_{op2}$ to $t_{op4}$).

The same can be applied also when performing a closing operation in a reversal way.

It has been observed in practice that the hybrid current switching device 100 allows achieving some improvements over known solutions according to a solution quite simple and compact with consistent operation sequence and timing over the whole working life.

Indeed, the device 100 embodies into a unique device the functions of a current circuit breaker (e.g., the main current switch 10), of a galvanic or isolation switch (e.g., the secondary current switch 30) and of a static or solid-state circuit breaker (e.g., the power electronics switch 20) which operate in a very effective and coordinated way. By using a single actuating mechanism 5 for actuating both the main and secondary current switches 10, 30, the overall constructive layout of the device is made simpler and the mechanical synchronization between the two switches 10 and 30 is intrinsically improved and better guaranteed over the working life. The use of self-locking motors and especially of self-locking piezoelectric motors makes it easier since they can be even directly coupled to the shaft 4 without a gearbox. In addition, being self-locking when non-powered, such motors can hold the shaft 4 in a closed position against the load of the contact springs without the need of a mechanical latch. The use of two contact-pressing springs having different stiffness contributes to increase the flexibility of design and/or to improve the way the desired sequence is obtained. For example, it is possible to achieve the needed design load with different charging strokes.

The hybrid device 100 thus conceived is susceptible of modifications and variations, all of which are within the scope of the inventive concept as defined in the appended claims and previously described, including any combinations of the above described embodiments which have to be considered included in the present disclosure even though not explicitly described; all details may further be replaced with other technically equivalent elements. For example, the hybrid device 100 has been described by making reference to a molded case circuit breaker but it can be any type of similar current protection devices, e.g. a modular circuit breaker (MCB) a disconnector, et cetera; further, from a constructive point of view the hybrid device 100 as illustrated resembles a bipolar (IS 30 and MS 10 are positioned side-by-side as 2 poles) AC circuit breaker with only one phase electrically connected to the related circuit, but it can be clearly used in DC applications, and with any suitable number of phases either in AC or DC applications. For example, in case it has to be connected to two phases of an associated circuit, the device 100 would resemble a tetrapolar circuit breaker, namely the components of FIGS. 3-7 would be doubled, with an alternance in sequence along the shaft 4, of a first main current switch 10, an associated first secondary current switch 30, a second main current switch 10, an associated second secondary current switch 30. The power electronics switch 20 can comprise other types of semiconductor-based components, e.g. IGCTs; et cetera.

In practice, the materials, as well as the dimensions, could be of any type according to the requirements and the state of the art.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A hybrid current switching device comprising:

a casing having protruding outside thereof a first terminal and a second terminal configured for input and output electrical connection with an associated electrical circuit, respectively, wherein the hybrid current switching device comprises, positioned inside the casing:

a main current switch including a first fixed contact and a corresponding first movable contact, the first fixed and movable contacts being connected in series with and positioned between the first and second terminals;

a power electronics switch configured to be connected in parallel with the main current switch and to be switched between an on-state and an off state;

a secondary current switch having a second fixed contact and a corresponding second movable contact, the secondary current switch being connected in series with the power electronics switch; and a movable-contacts holding shaft on which the first movable contact and the second movable contact are mounted, the movable-contacts holding shaft being positioned inside the casing rotating around a rotation axis so as to move the first and second movable contacts between a closed position in which the first and second movable contacts are coupled with the first and second fixed contacts, respectively, and an open position in which the first and second movable contacts are electrically separated from the first and second fixed contacts, wherein the first and second movable contacts are mounted on the movable-contacts holding shaft with an angular offset relative to each other when in the open position.

2. The hybrid current switching device according to claim 1, comprising:

a single actuation mechanism operatively connected to the movable-contacts holding shaft for actuating both the main current switch and the secondary current switch.

3. The hybrid current switching device according to claim 2, wherein the actuating mechanism is configured to cause the first and second movable contacts to be substantially aligned to each other when in the closed position.

4. The hybrid current switching device according to claim 1, wherein the first and second movable contacts are mounted on the movable-contacts holding shaft such that when opening the main current switch and the secondary current switch, the second movable contact starts to physically separate from the second fixed contact only when the first movable contact is spaced apart from the first fixed contact of at least a predetermined distance.

5. The hybrid current switching device according to claim 2, wherein the single actuation mechanism is configured to move the movable-contacts holding shaft at a variable angular speed when rotating from the closed position to the open position.

6. The hybrid current switching device according to claim 1, wherein the angular offset is between 3° and 60°.

7. The hybrid current switching device according to claim 1, wherein the actuating mechanism comprises:

a first contact-pressing spring operatively connected to the first movable contact; and a second contact-pressing spring operatively connected to the second movable contact, wherein the first and second contact-pressing springs have a related stiffness such that, in a closed position under the action of the actuating mechanism, the contact force exerted on the second movable contact is higher than that exerted on the first movable contact.

8. The hybrid current switching device according to claim 2, comprising:

a command unit configured to switch the power electronics switch from an off-state to an on-state before the first movable contact starts to physically separate from the first fixed contact when opening the main current switch and the secondary current switch.

9. The hybrid current switching device according to claim 8, wherein the command unit is configured to switch the power electronics switch from an on-state to an off-state after the first movable contact is spaced apart from the first fixed contact of at least a predetermined distance and before the second movable contact starts to physically separate from the second fixed contact when opening the main current switch and the secondary current switch.

10. The hybrid current switching device according to claim 8, wherein the command unit is configured to switch the power electronics switch from an on-state to an off-state after the second movable contact is coupled with the second fixed contact and before the first movable contact starts to physically touch the first fixed contact when closing the main current switch and the secondary current switch.

11. The hybrid current switching device according to claim 8, wherein the command unit is configured to drive the single actuating mechanism.

12. The hybrid current switching device according to claim 2, wherein the single actuating mechanism includes a self-locking motor.

13. The hybrid current switching device according to claim 12, wherein the self-locking motor includes a piezoelectric motor.

14. The hybrid current switching device according to claim 1, wherein the secondary current switch is connected in series with the main current switch.

15. The hybrid current switching device according to claim 5, comprising:

a command unit configured to switch the power electronics switch from an off-state to an on-state before the first movable contact starts to physically separate from the first fixed contact when opening the main current switch and the secondary current switch.

16. The hybrid current switching device according to claim 15, wherein the command unit is configured to switch the power electronics switch from an on-state to an off-state after the first movable contact is spaced apart from the first fixed contact of at least a predetermined distance and before the second movable contact starts to physically separate from the second fixed contact when opening the main current switch and the secondary current switch.

17. The hybrid current switching device according to claim 15, wherein the command unit is configured to switch the power electronics switch from an on-state to an off-state after the second movable contact is coupled with the second fixed contact and before the first movable contact starts to physically touch the first fixed contact when closing the main current switch and the secondary current switch.

18. The hybrid current switching device according to claim 15, wherein the actuating mechanism is configured to cause the first and second movable contacts to be substantially aligned to each other when in the closed position.

* * * * *